US011761607B1

(12) United States Patent
Bessinger

(10) Patent No.: US 11,761,607 B1
(45) Date of Patent: Sep. 19, 2023

(54) LIGHTING DISPLAY

(71) Applicant: New Signature Homestyles, LLC, Buffalo Grove, IL (US)

(72) Inventor: Paul A. Bessinger, Buffalo Grove, IL (US)

(73) Assignee: New Signature Homestyles, LLC, Buffalo Grove, IL (US)

( * ) Notice: Subject to any disclaimer, the term of this patent is extended or adjusted under 35 U.S.C. 154(b) by 0 days.

(21) Appl. No.: 17/976,295

(22) Filed: Oct. 28, 2022

Related U.S. Application Data

(63) Continuation-in-part of application No. 17/952,779, filed on Sep. 26, 2022.

(51) Int. Cl.

| | |
|---|---|
| ***F21V 3/04*** | (2018.01) |
| ***F21S 6/00*** | (2006.01) |
| ***F21V 1/12*** | (2006.01) |
| *F21Y 115/10* | (2016.01) |

(52) U.S. Cl.
CPC ..... *F21V 3/049* (2013.01); *F21S 6/002* (2013.01); *F21V 1/12* (2013.01); *F21Y 2115/10* (2016.08)

(58) Field of Classification Search
CPC ..... F21V 17/002; F21V 17/06; F21V 3/0625; F21S 4/10; G09F 2007/1891; G09F 13/0458; G09F 13/0481
See application file for complete search history.

(56) References Cited

U.S. PATENT DOCUMENTS

| | | | | |
|---|---|---|---|---|
| 3,456,106 | A * | 7/1969 | Mischa | F21V 1/00 40/554 |
| 5,513,084 | A * | 4/1996 | Simpson | A47G 33/0809 362/284 |
| 11,421,850 | B1 * | 8/2022 | Hsiao | F21S 10/00 |
| 2005/0022436 | A1 * | 2/2005 | Lehmkuhl | G09F 19/12 40/716 |
| 2007/0165195 | A1 * | 7/2007 | Lockett | F21V 1/12 353/120 |
| 2008/0130266 | A1 * | 6/2008 | DeWitt | A61L 9/12 422/123 |
| 2009/0323315 | A1 * | 12/2009 | Tuite | G09F 13/04 362/98 |
| 2011/0157483 | A1 * | 6/2011 | Reichow | H04N 9/3197 348/E3.012 |
| 2014/0268704 | A1 * | 9/2014 | Yang | F21S 6/001 362/185 |

* cited by examiner

*Primary Examiner* — Leah Simone Macchiarolo
(74) *Attorney, Agent, or Firm* — Adam K. Sacharoff; Much Shelist, P.C.

(57) ABSTRACT

There is provided a lighting display defined to include a base housing a power source compartment. A cylindrical shell extends upwardly from an edge of the base. A plurality of light diodes is electrically connected to the power source and extend from the base. A sheet of material is curved and inserted against an inside surface of the shell. The material is configured to have a flat configuration but is capable of being curved such that when curved and inserted against the inside surface of the shell, the sheet has a tendency to press against the inside surface, attempting to return to the flat configuration. The plurality of light diodes being positioned interior to the sheet of material illuminate the sheet of material when activated.

13 Claims, 20 Drawing Sheets

170

100

LIGHTING DISPLAY

CROSS REFERENCE TO RELATED APPLICATIONS

The present application is a Continuation In Part of U.S. application Ser. No. 17/952,779 filed on Sep. 26, 2022.

FIELD OF THE INVENTION present invention relates to lighting display.

BACKGROUND OF THE INVENTION

Lamps and lighting displays do not always simply have to provide illumination. Lighting displays have been developed to provide more aesthetic qualities. For example, lava lamps can provide some illumination but also help to provide an aesthetic to the room. There is therefore a need to create and provide a display with aesthetic qualities but also allows the user to easily change the aesthetics of the lighting display.

SUMMARY OF THE INVENTION

In accordance with an embodiment of the present invention there is provided a lighting display defined to include a base housing a power source compartment. A cylindrical shell extends upwardly from an edge of the base. A plurality of light diodes is electrically connected to the power source and extend from the base. A sheet of material is curved and inserted against an inside surface of the shell. The material is configured to have a flat configuration but is capable of being curved such that when curved and inserted against the inside surface of the shell, the sheet has a tendency to press against the inside surface, attempting to return to the flat configuration. The plurality of light diodes being positioned interior to the sheet of material illuminate the sheet of material when activated.

Other aspects are provided such as various sheets of material can be used with different patterns and indicia. The diodes could also change colors and have different blinking patterns to create various effects, such as, but not limited to sparkling.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein:

FIG. 7 is another perspective view of FIG. 1 showing the light diodes turned on;

FIG. 8 is another perspective view of FIG. 1 showing the light diodes in the shell and turned on;

FIG. 9 is another perspective view of FIG. 1 showing a sheet of material in the shell and the light diodes turned on;

FIG. 11 is another perspective view of FIG. 1 showing one of the alternative sheets of material in the display while turned on.

DETAILED DESCRIPTION OF THE EMBODIMENTS

Figure 1:
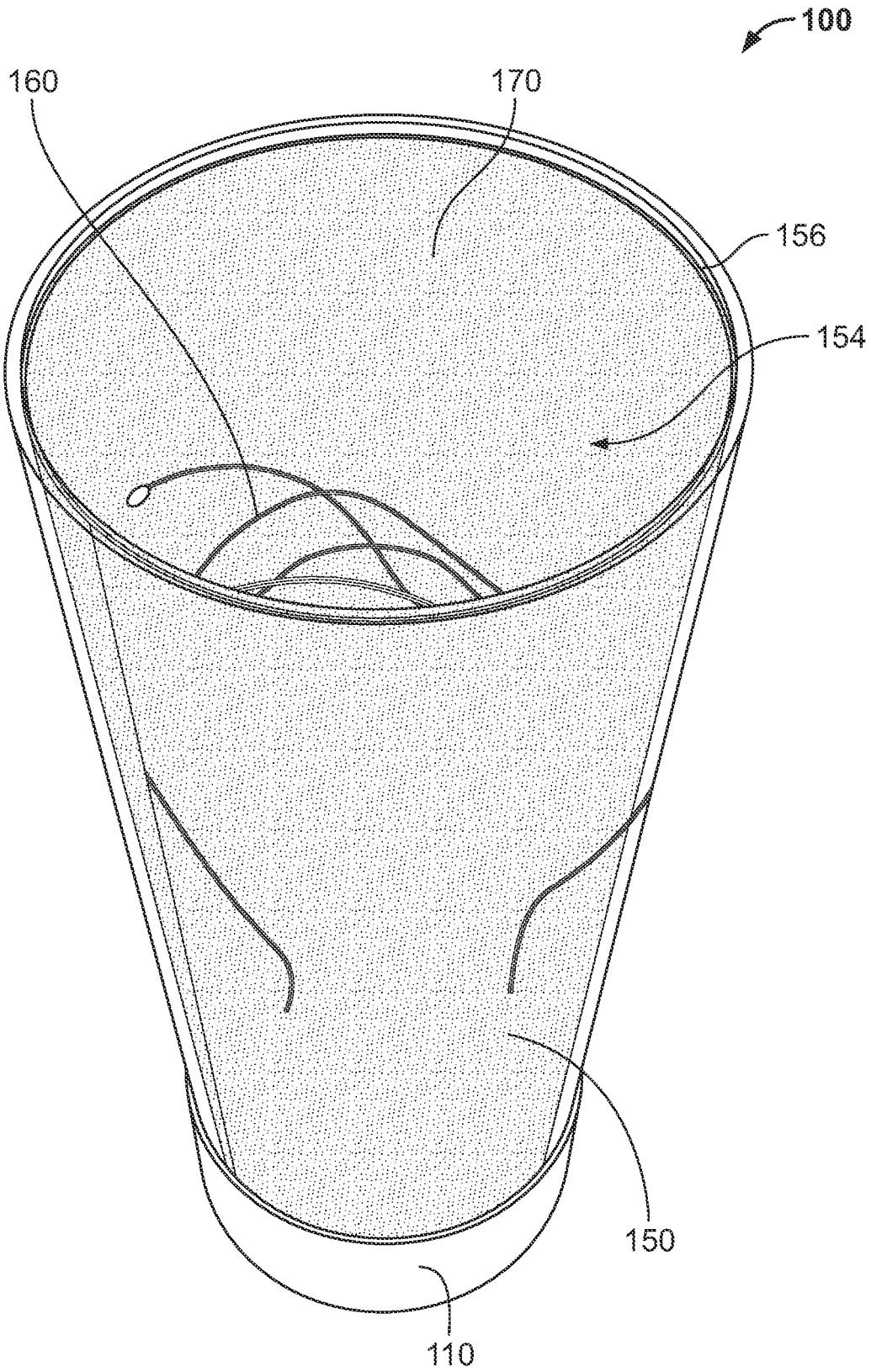
FIG. 1 is a perspective view of an embodiment of the present invention showing the lighting display.
Figure 2:
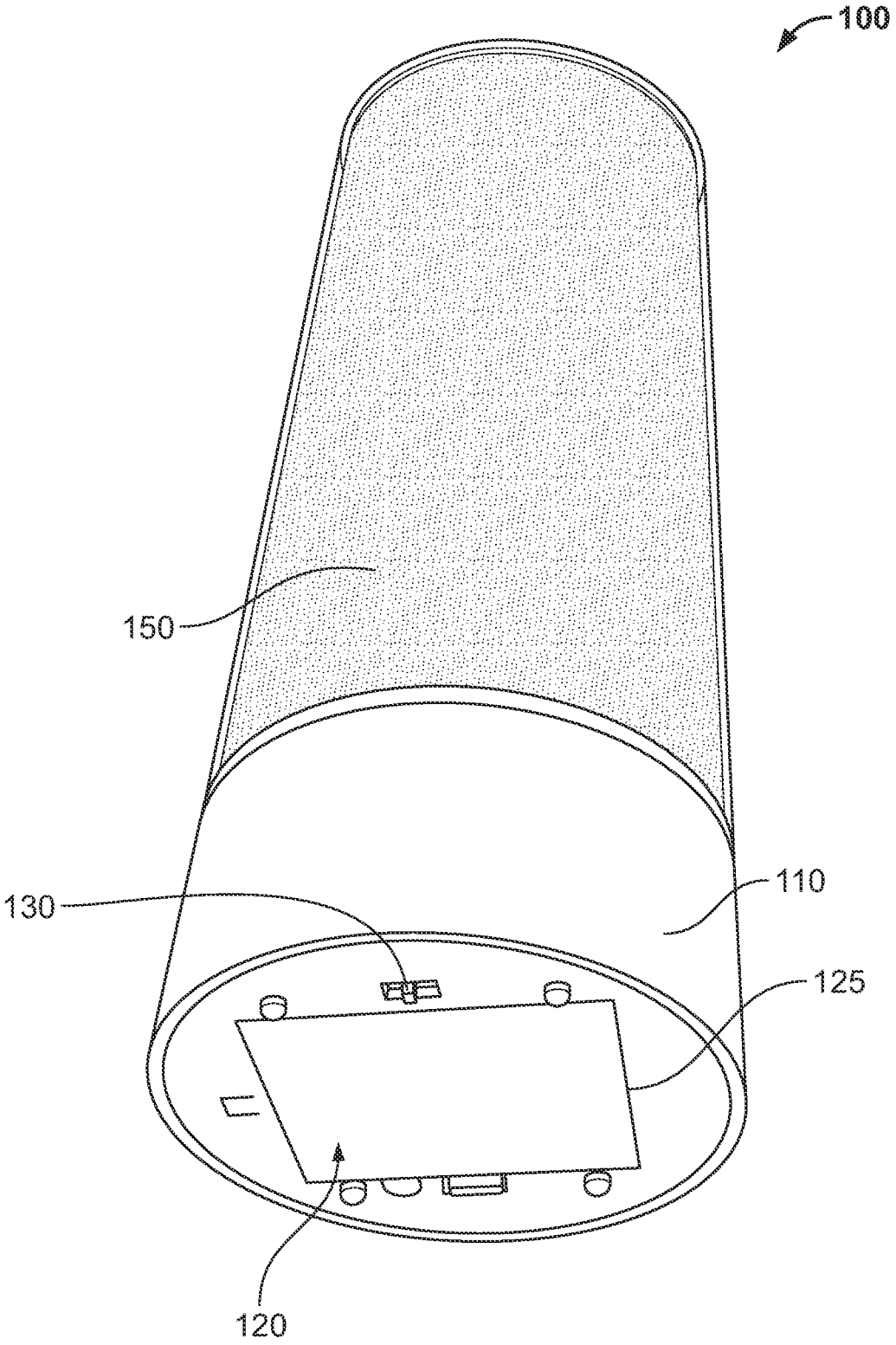
FIG. 2. is another perspective view of FIG. 1 showing the base of the lighting display.
Figure 3:
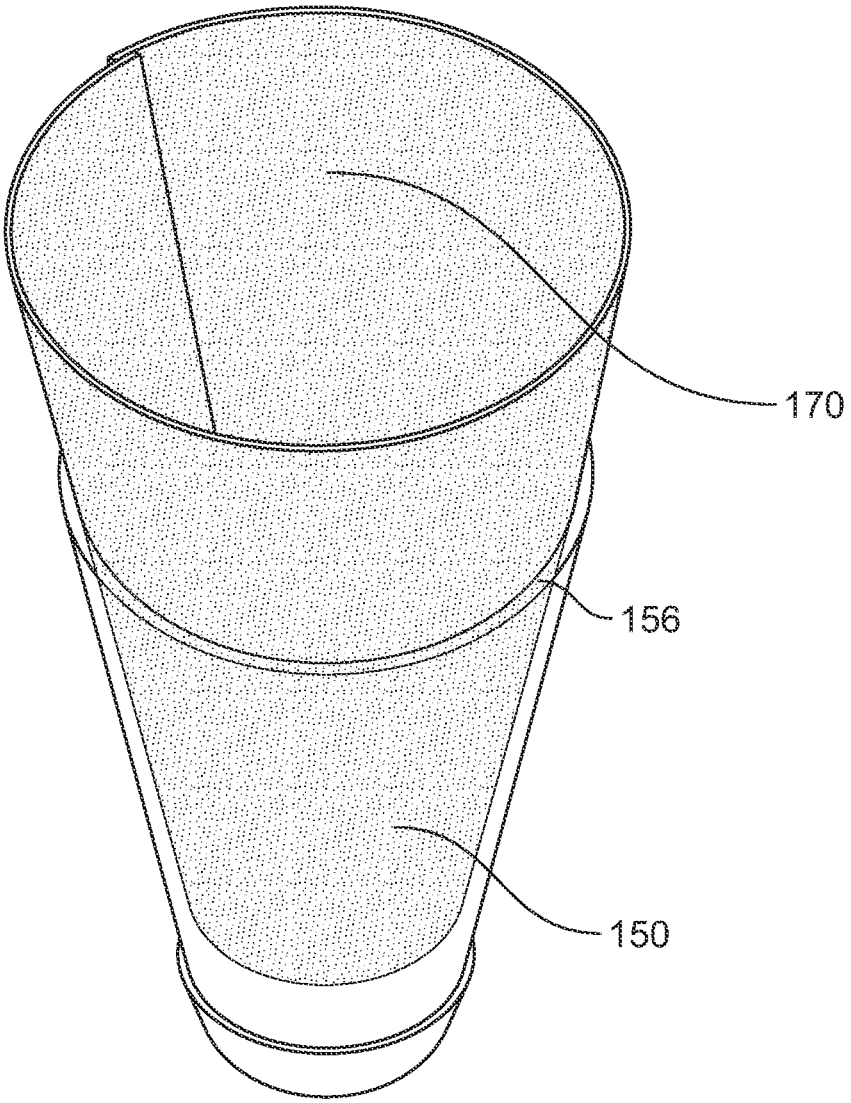
FIG. 3 is another perspective view of FIG. 1 showing the sheet of material slighting removed from the shell.
Figure 4:
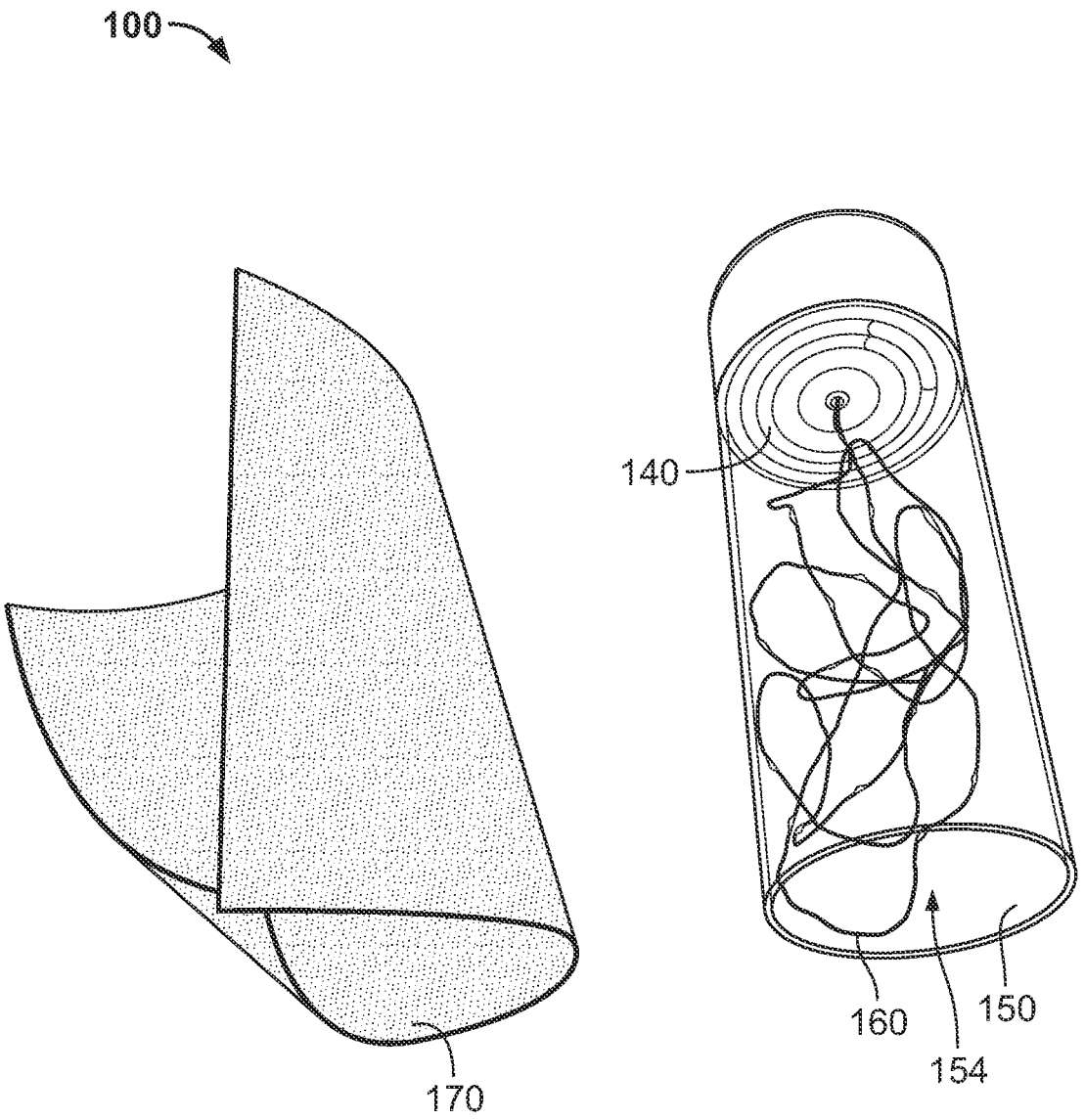
FIG. 4 is another perspective view of FIG. 1 showing the sheet of material removed from the shell.
Figure 5:
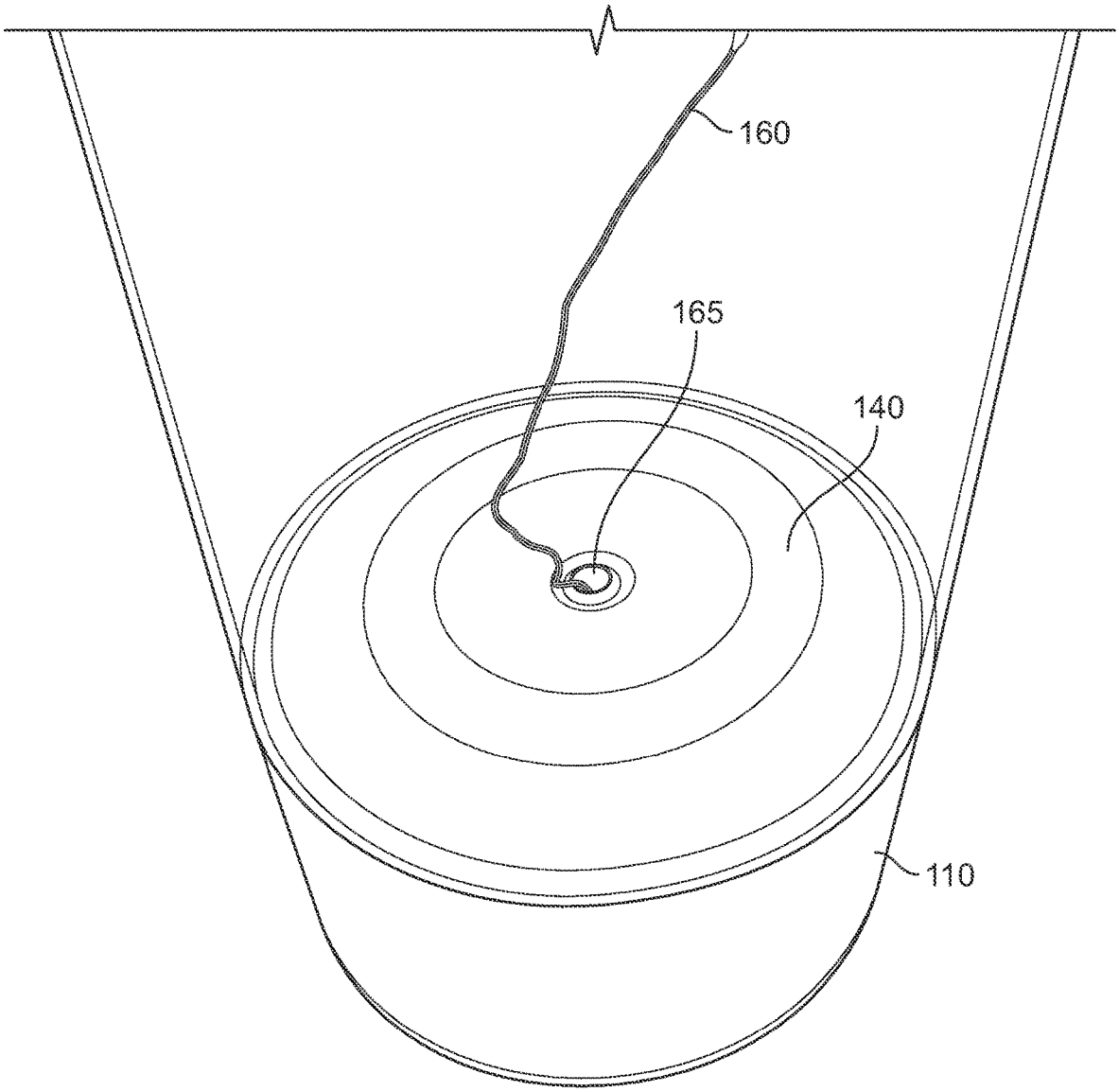
FIG. 5 is another perspective view of FIG. 1 showing light diodes extending from the base.
Figure 6:
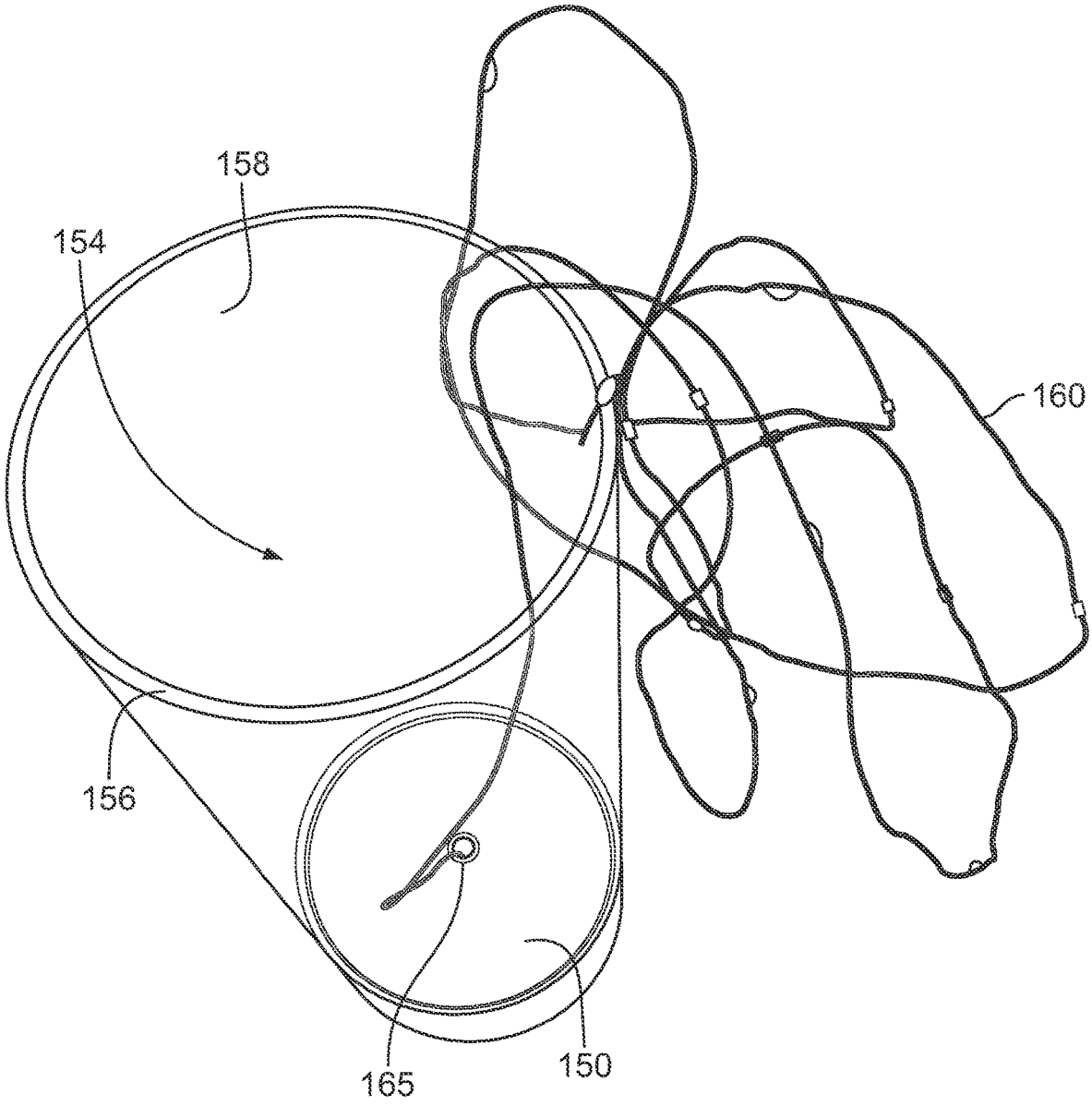
FIG. 6 is another perspective view of FIG. 1 showing the light diodes out of the shell.
Figure 7:
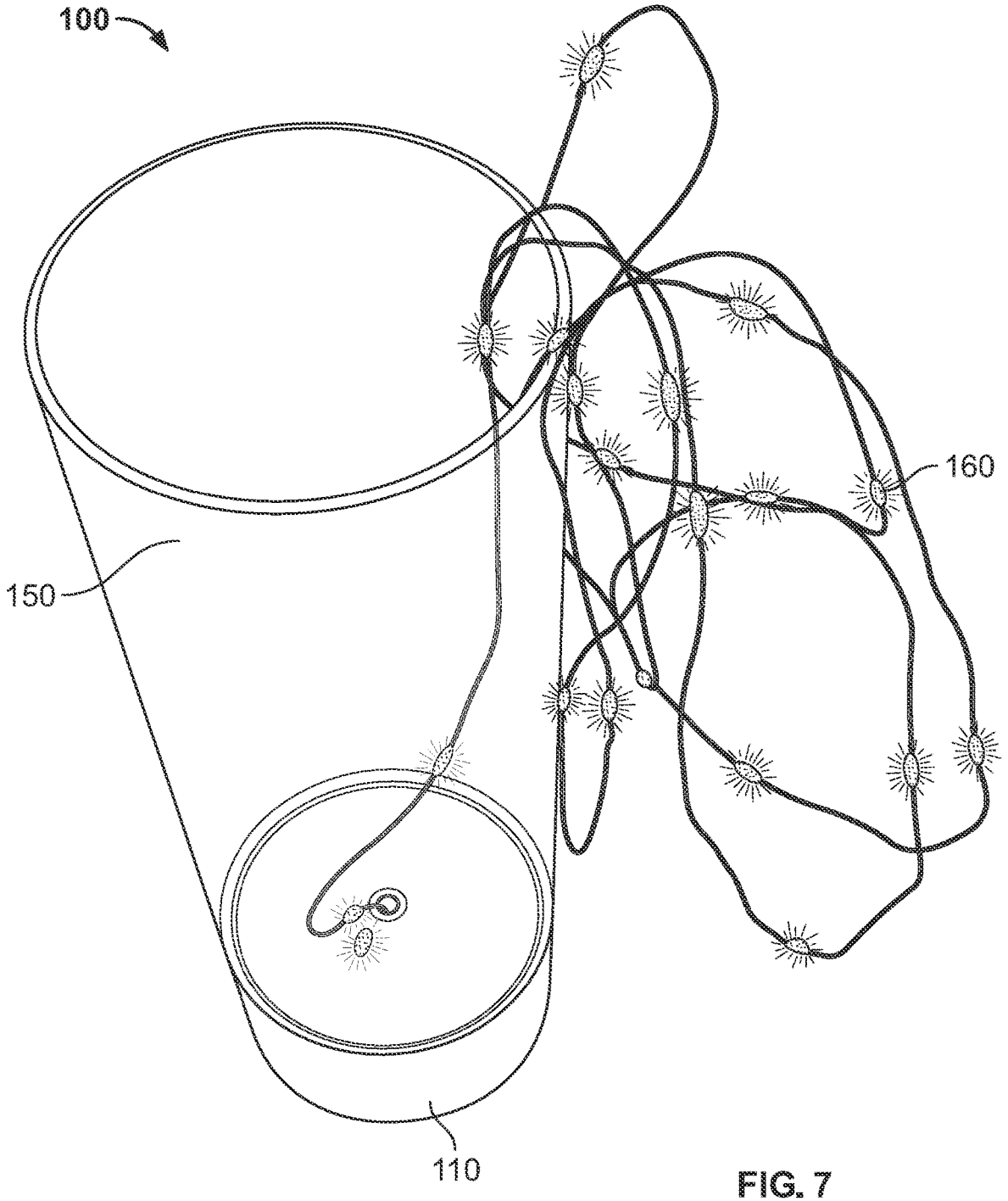
Figure 8:
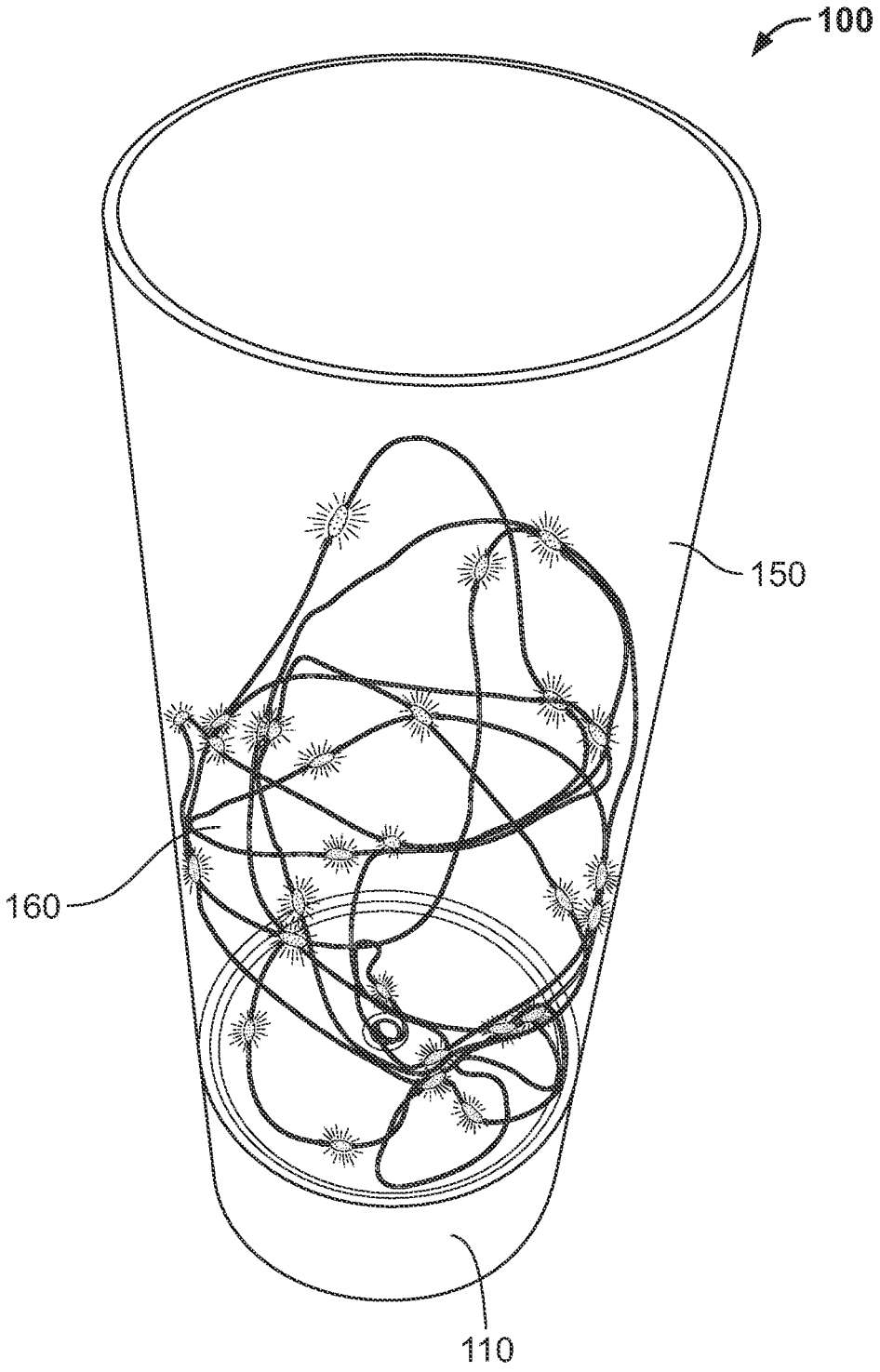
Figure 9:
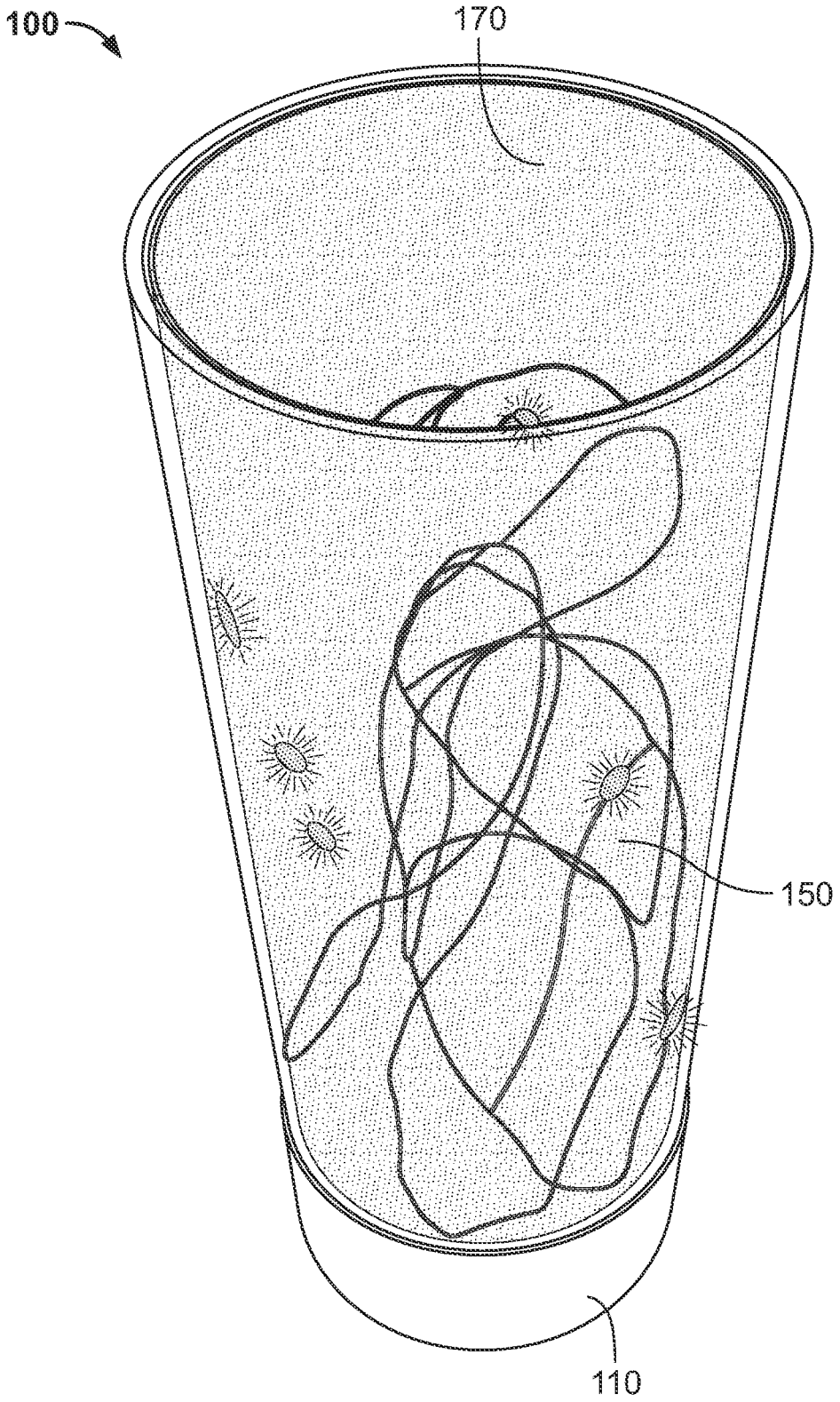
Figure 10:
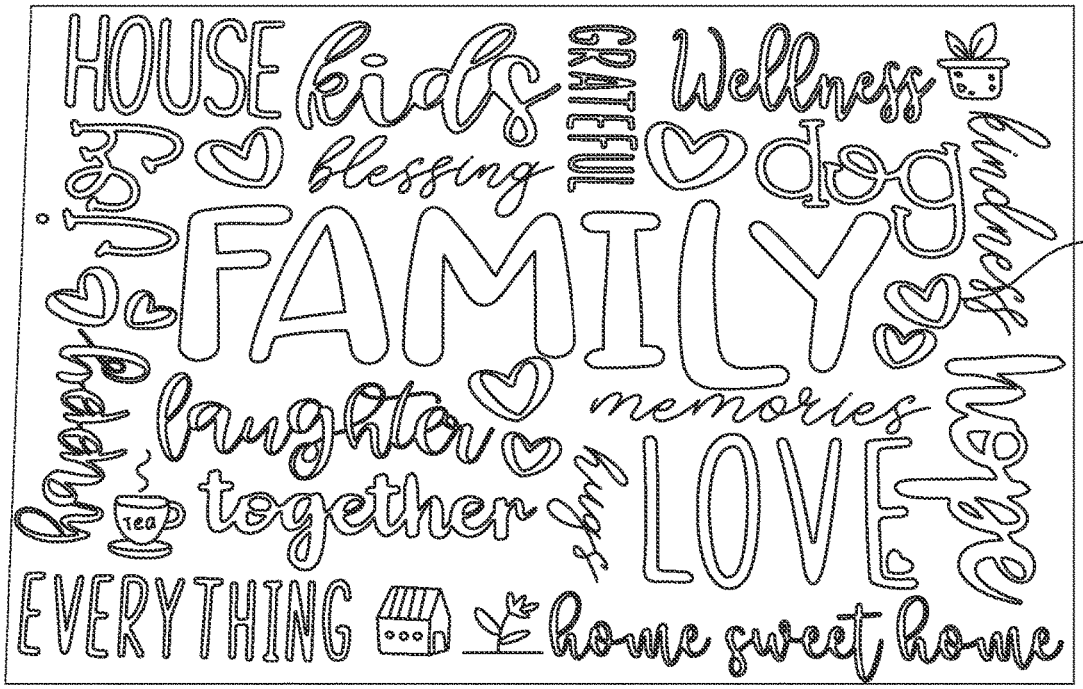
FIG. 10 shows alternative sheets of material.
Figure 10:
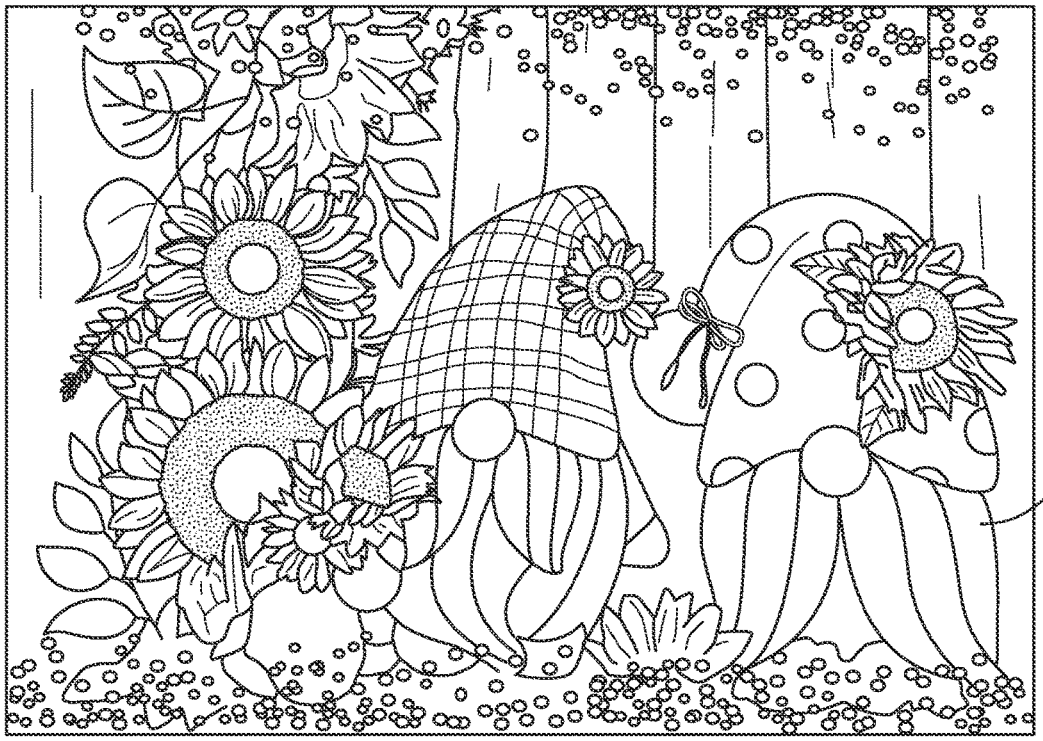
Figure 11:
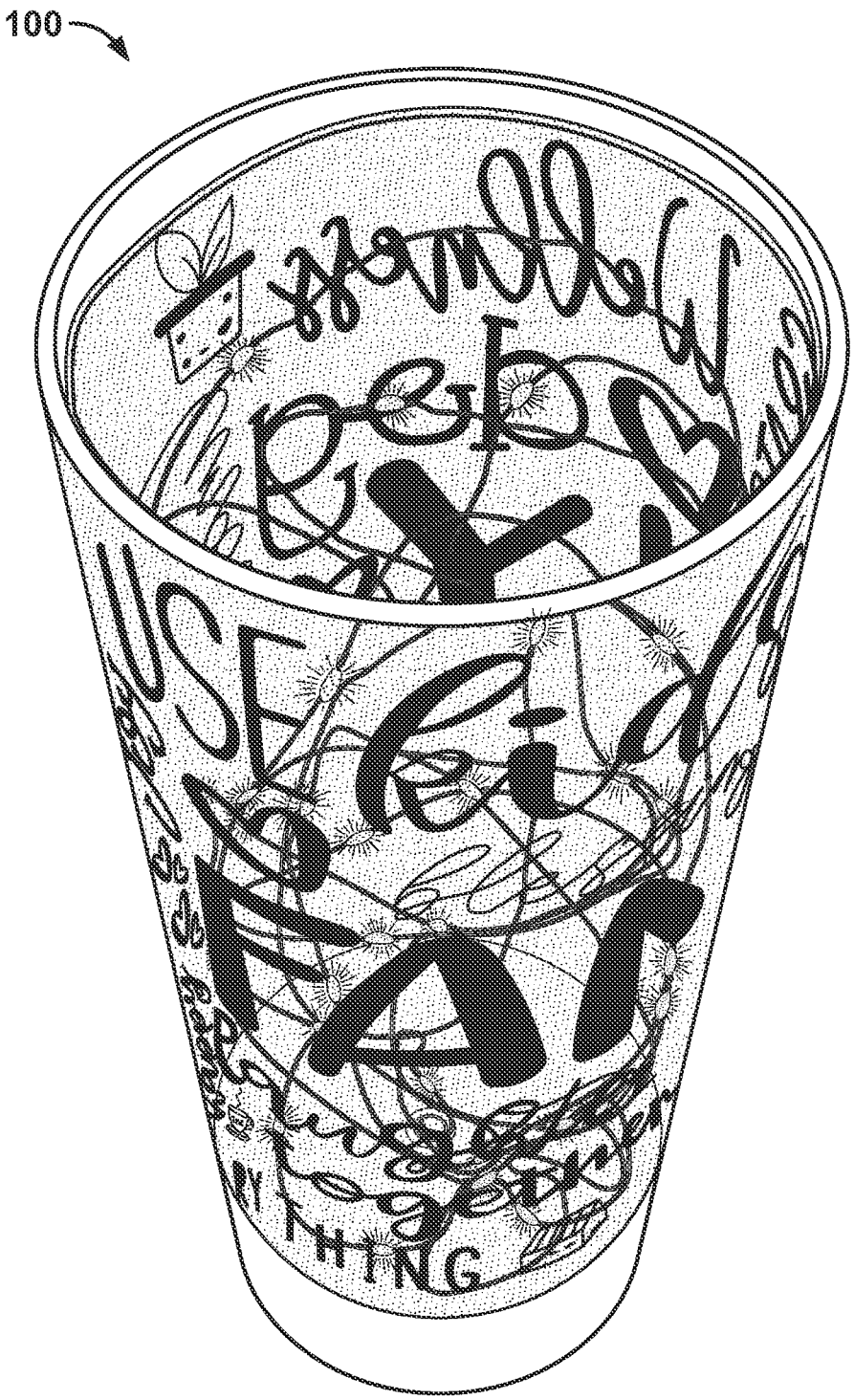

Referring now to FIGS. 1-13, there is shown a lighting display 100. The display 100 includes a base 110 housing the battery or power source compartment 120 with a compartment door 125 and an on/off switch 130. The base 110 includes a horizontal upper portion 140. A cylindrical transparent or translucent shell 150 extends upwardly from the edge of the upper portion of the base 110. The shell 150 can be made of a glass or plastic material. The shell 150 is hollow 154 and has a lip or rounded terminal edge 156. A plurality of light diodes 160 electrically connected to the power source and controlled by the switch 130 extend from an opening 165 in the upper portion 140 of the base 110. The plurality of light diodes 160 may be a single color or have multi-color effects.

A sheet of material 170 is rolled or curved and inserted against the inside surface 158 of the shell 150. The material 170 is designed to have a flat configuration but is capable of being rolled or curved but has a tendency to lay flat, thus when rolled and inserted against the inside surface 158 of the shell 150, the material 170 has a tendency to return to its normal flat configuration. As such, the material 170 will hold its rolled shape against the inside surface 150 of the shell 150. When rolled and placed against the inside surface, the plurality of light diodes are positioned on the inside surface of the sheet of material 170.

The sheet of material 170 may be an acetate sheet, a transparency sheet, a milky paper or any type of semitransparent or translucent medium material. In one embodiment the sheet of material 170 includes a diffraction pattern, thus when inserted against the shell 150 the diffraction causing the lighting display to sparkle. In addition, when the light diodes change colors or blink the sparkle affect can appear as if it is dancing or moving around the display. Alternatively, the sheets of material can include designs, corporate logos, sports designs, or custom indicia.

Figure 12:
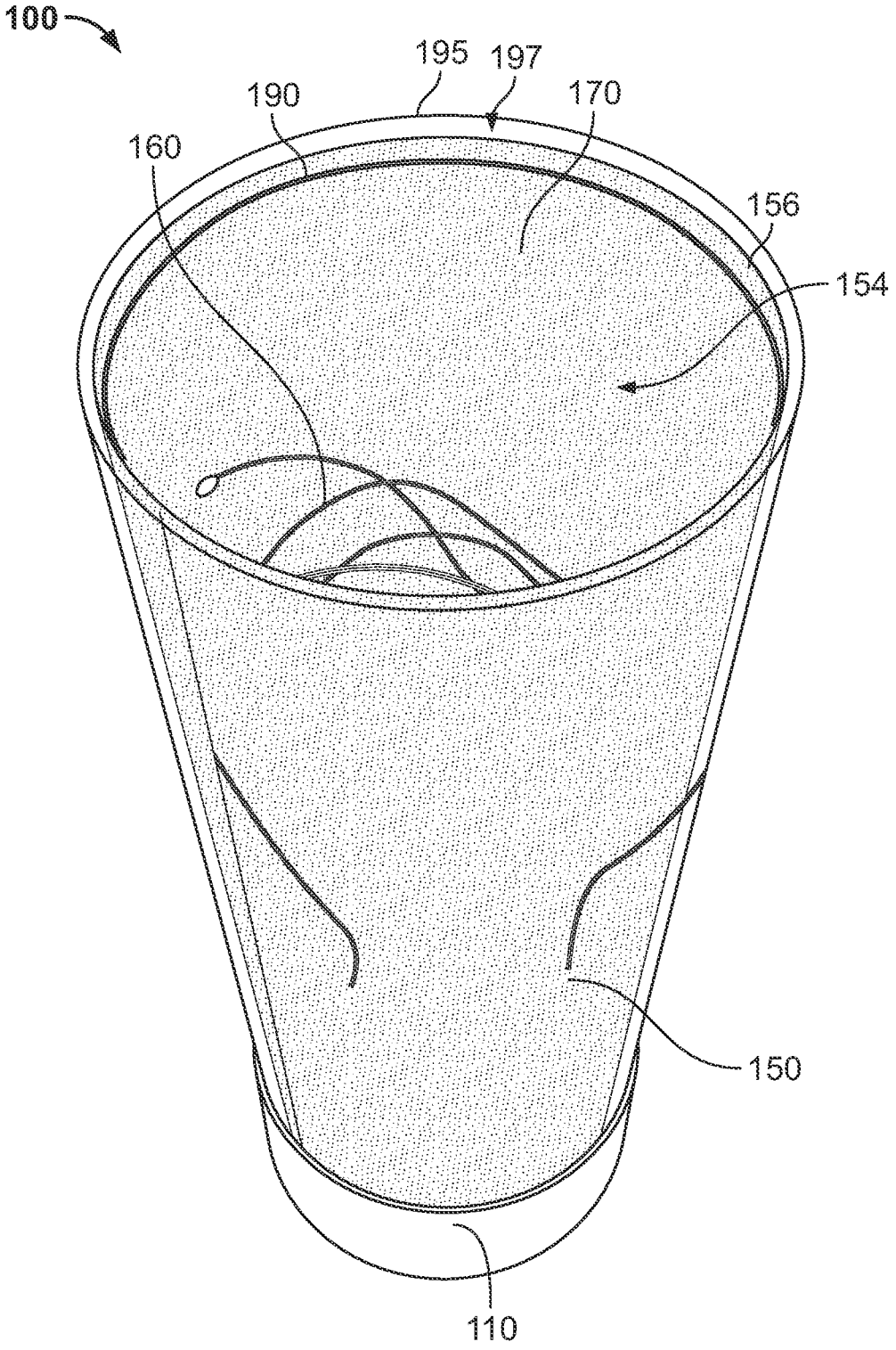
FIG. 12 is another embodiment of the present invention showing an inside and outside surface with a gap to hold the sheet of material.

In another alternative embodiment, FIG. 12 the shell 150 may include an inside surface 190 spaced from an outside surface 195 allowing the sheet of material 170 to be inserted into a gap 197 and held between the two surfaces. In this instance the inside surface 190 may be positioned lower than the outside surface to provide the user with a space to grip the sheet of material 170 when removing and replacing with other sheets.

Figure 13:
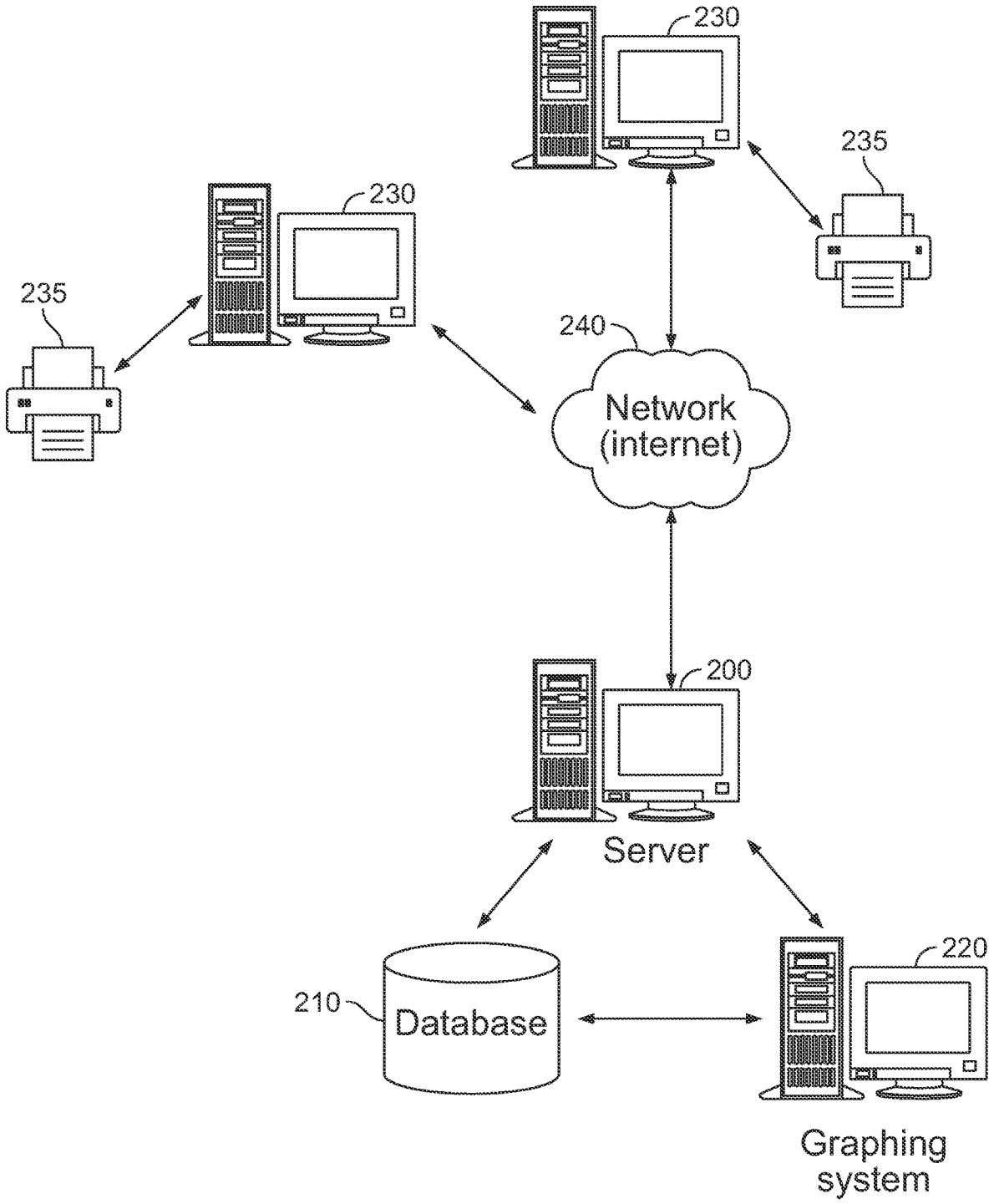
FIG. 13 illustrates a user's ability to custom create indicia on sheets of material.
Figure 14:
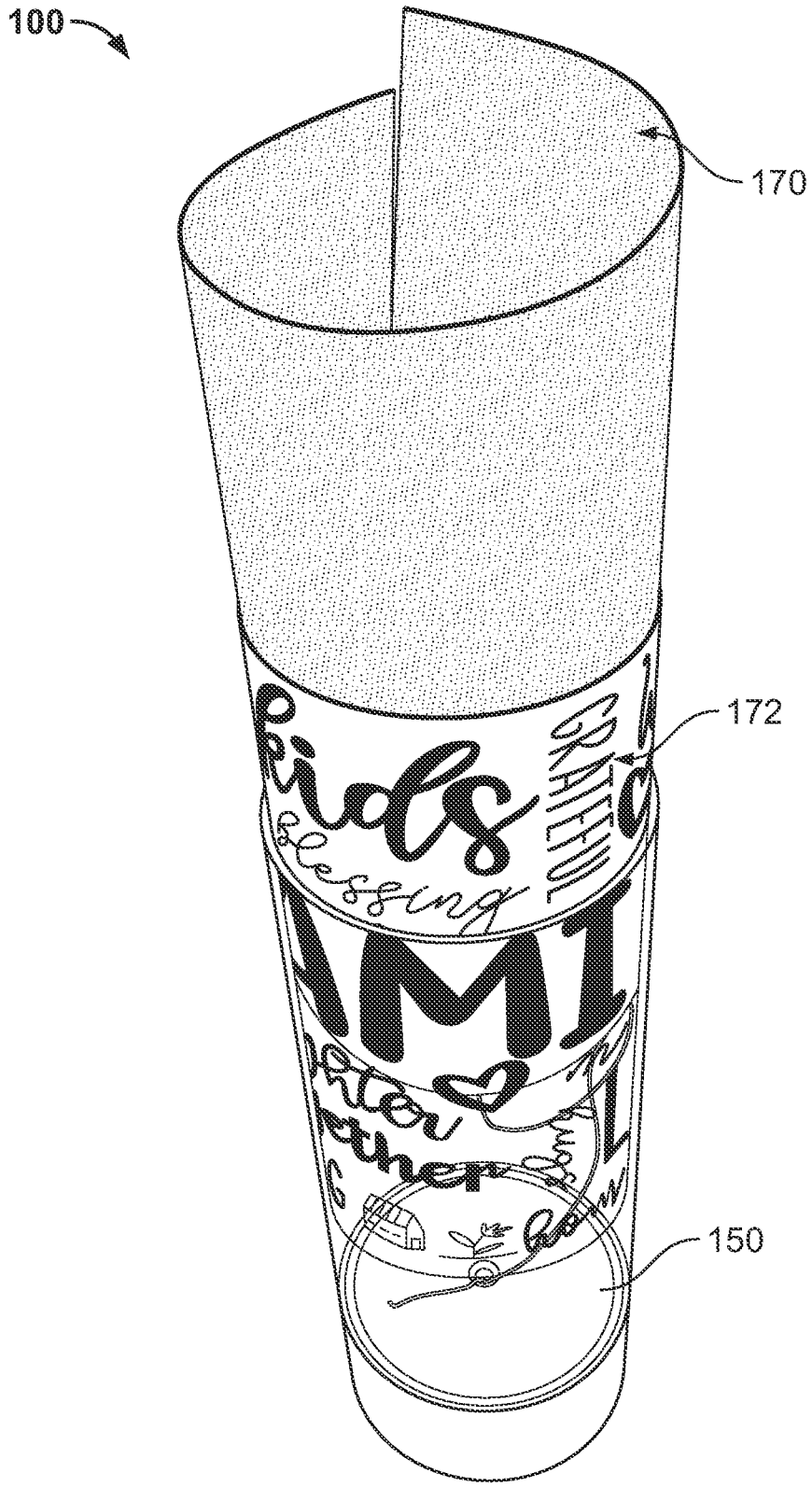
FIG. 14 is another embodiment of the present invention showing an diffuser insert behind the indicia insert.
Figure 15:
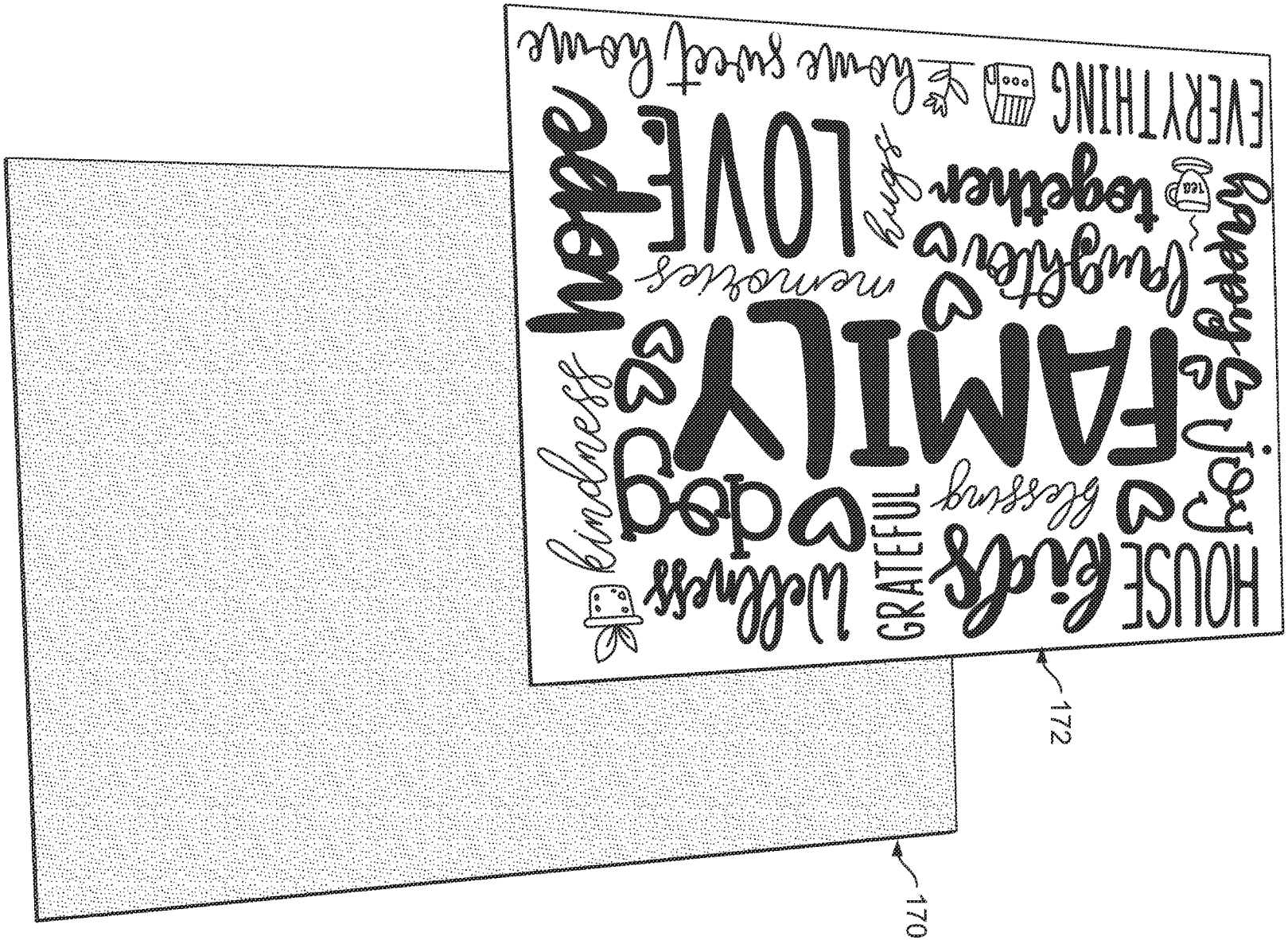
FIG. 15 is an illustration of the diffuser insert placed behind the indicia insert.
Figure 16:
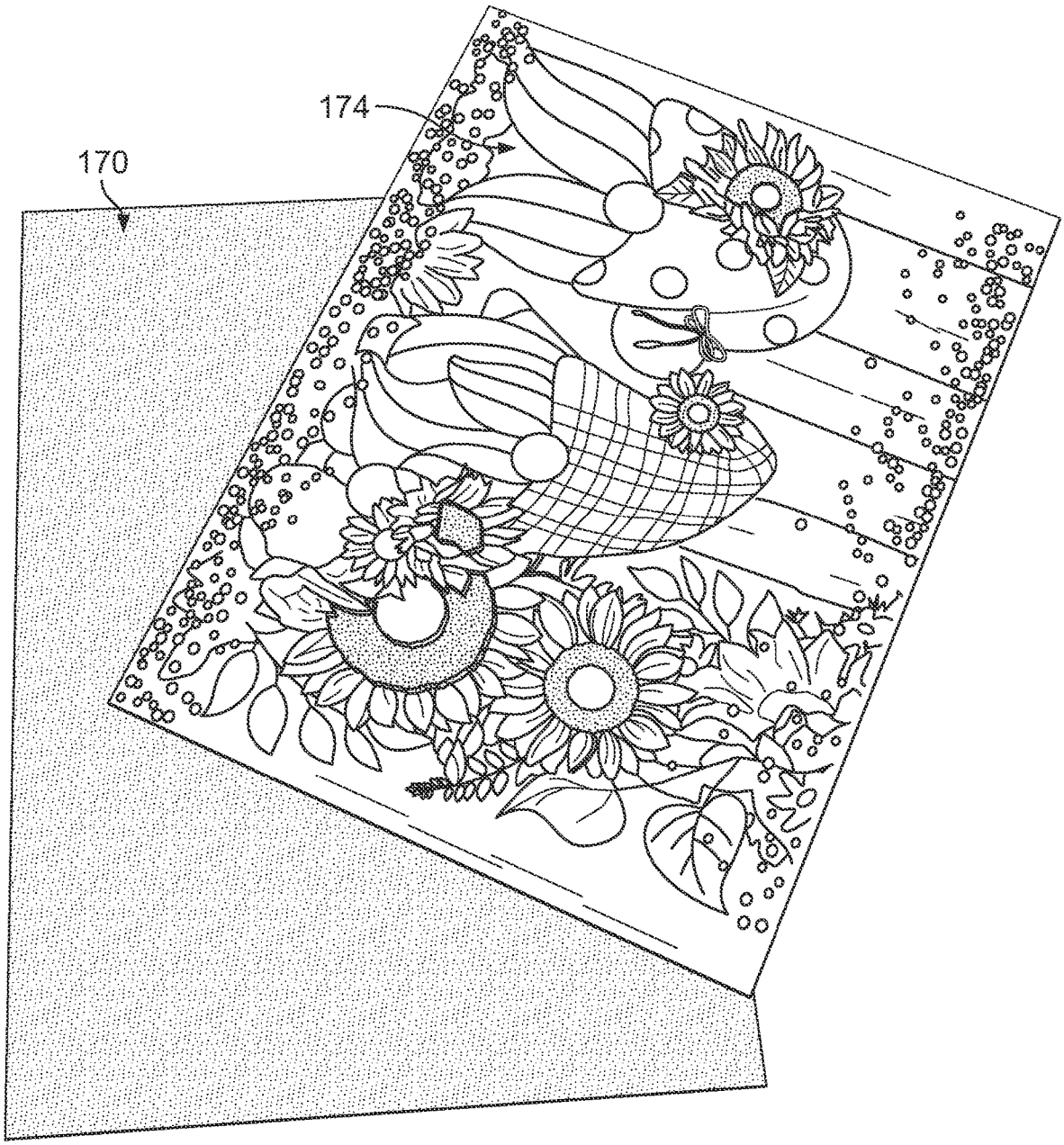
FIG. 16 is an illustration of the diffuser insert placed behind a different indicia insert.
Figure 17:
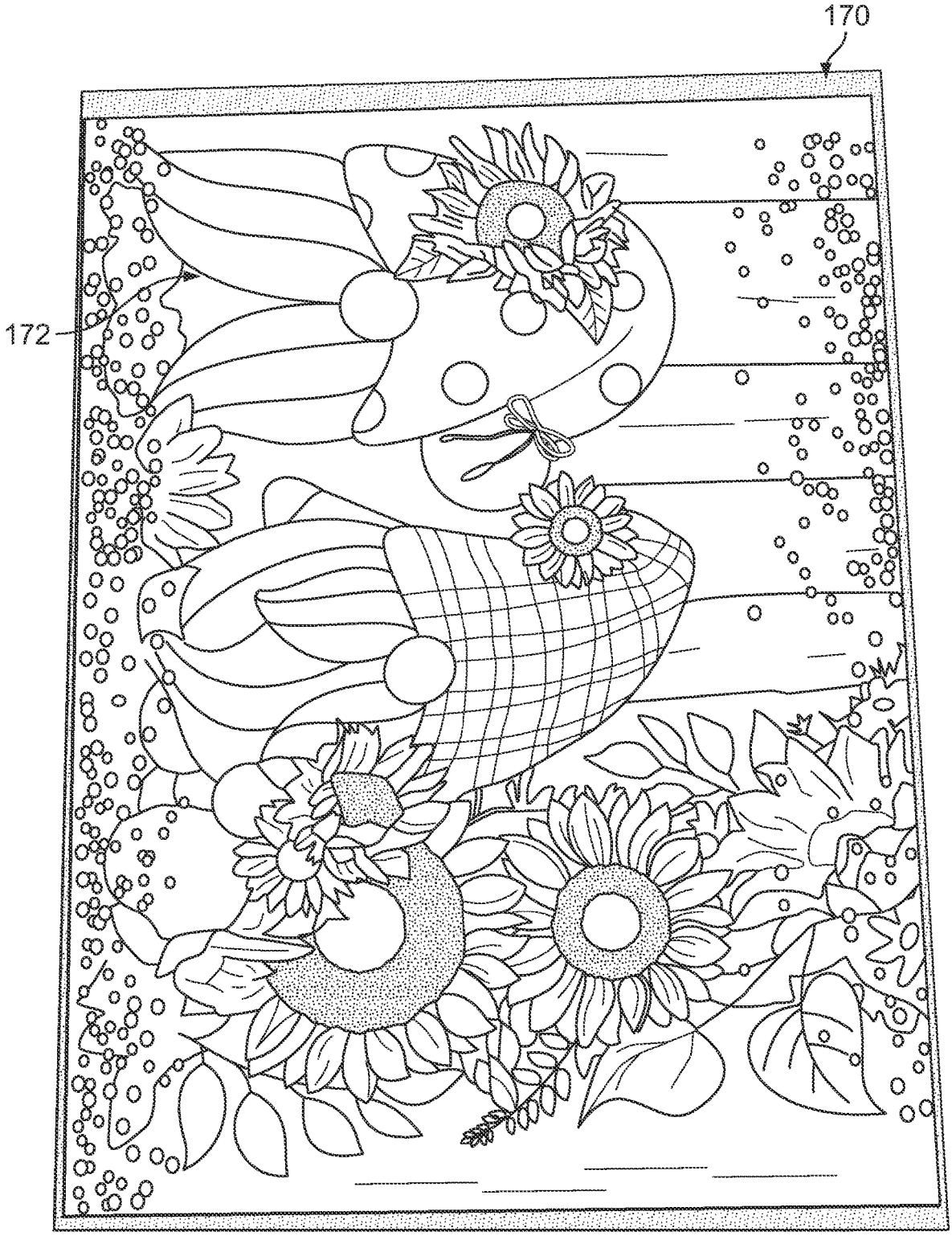
FIG. 17 is an illustration of the diffuser insert placed behind a different indicia insert.
Figure 18:
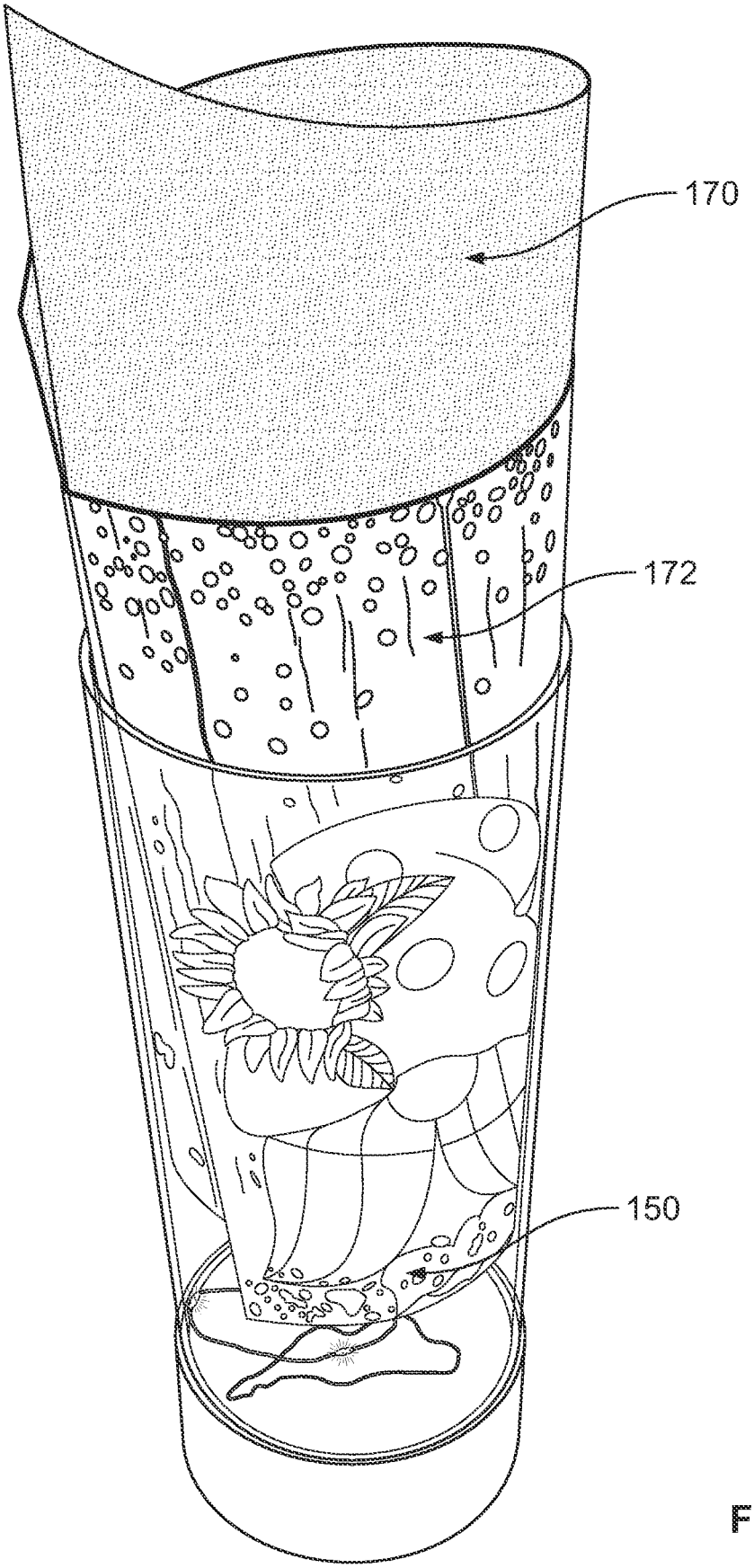
FIG. 18 is an illustration of the diffuser insert placed behind a different indicia insert and placed in the lighting display.
Figure 19:
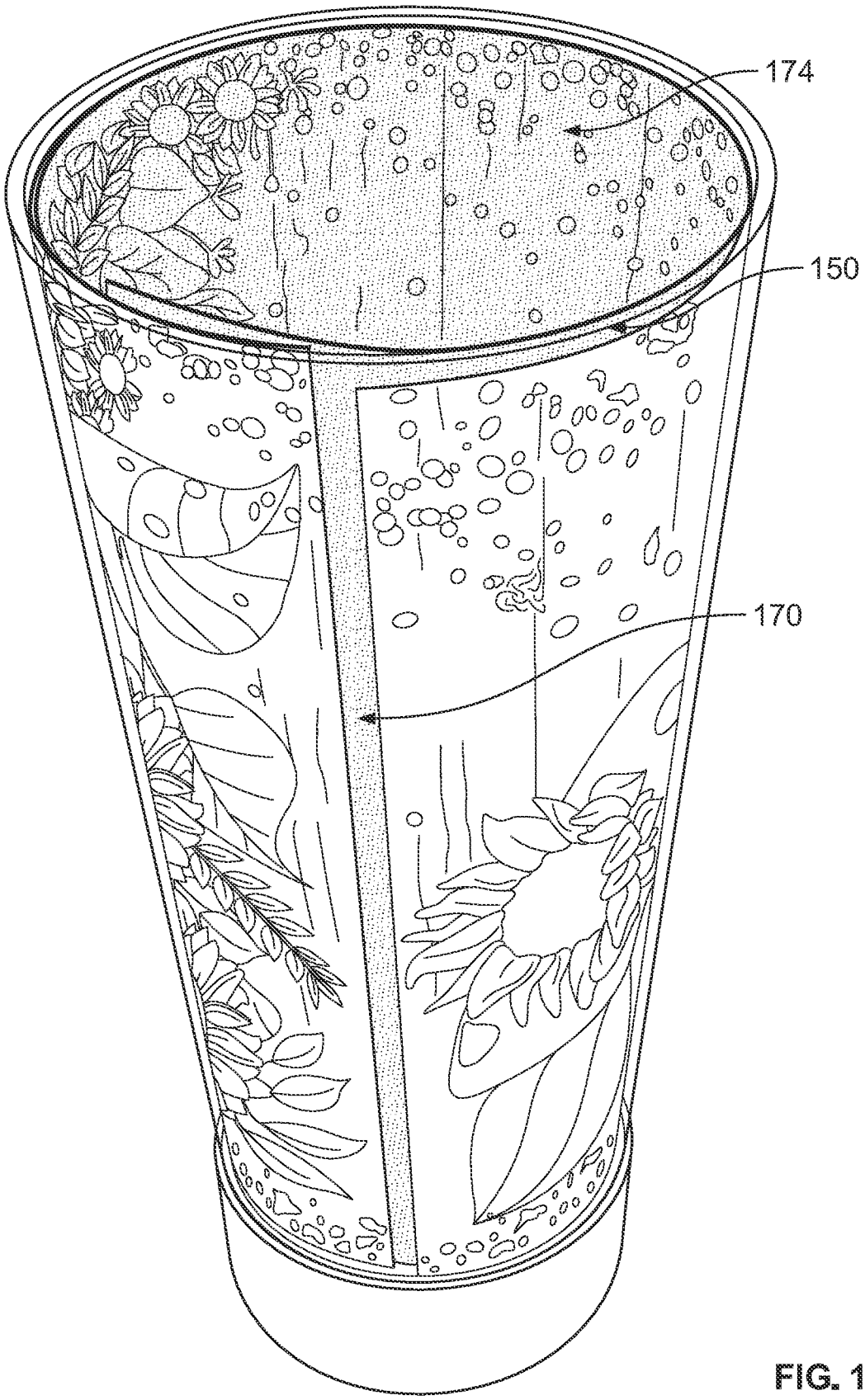
FIG. 19 is another perspective view of FIG. 18.
Figure 20:
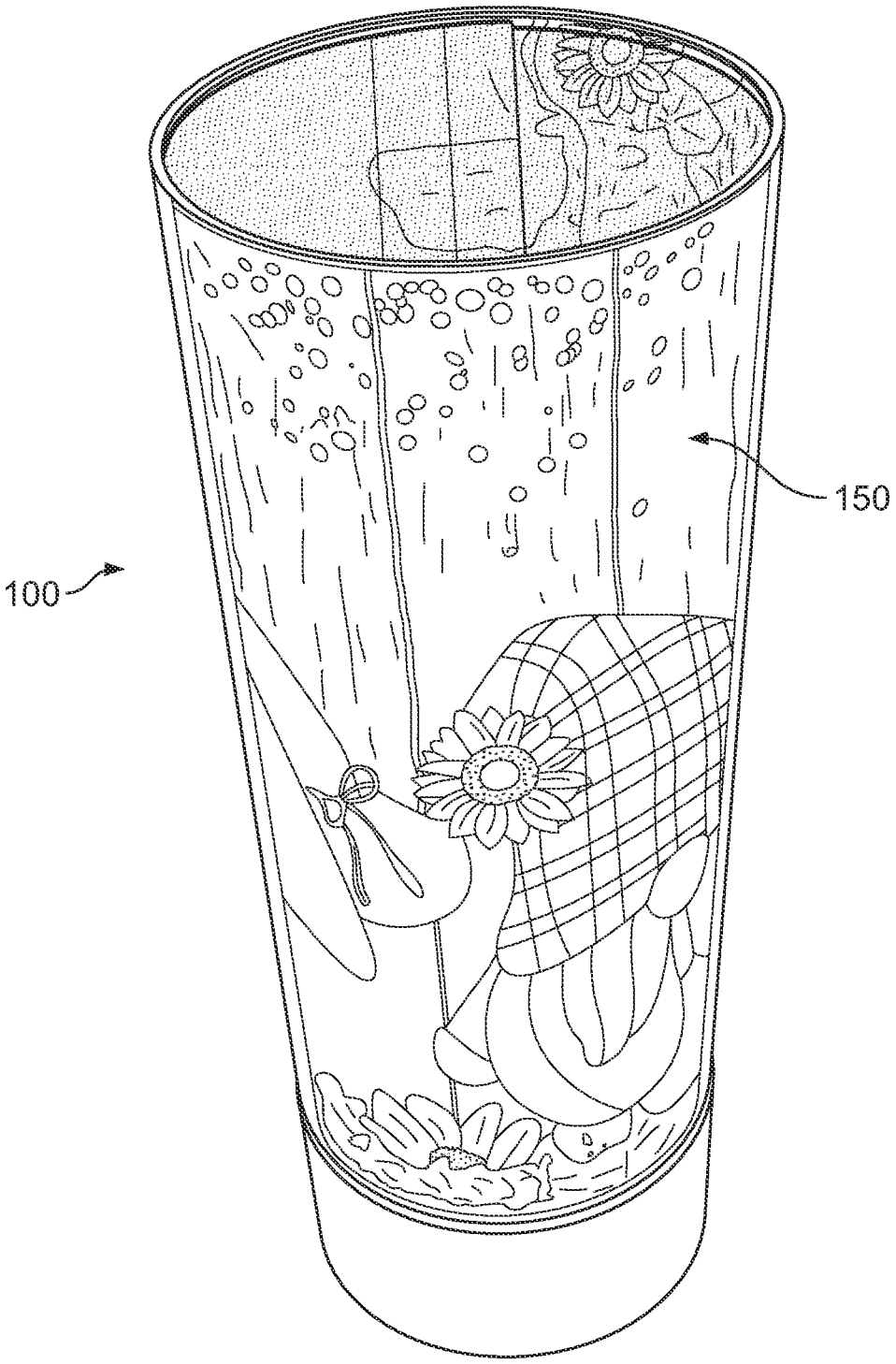
FIG. 20 is another perspective view of FIG. 18.

In another embodiment, FIG. 13, a user can purchase blank sheets of material and use a computer 230 and printer 235 to print custom or user created indicia on blank sheets of material. This provides the user with endless opportunities to custom design their display. Other aspects would allow the computer 230 to connected by a network or internet 240 to a server 200 that has access to a database 210 or graphing system 220 to upload or create various indicia or licensed materials on the blank sheets of material. This aspect can be used by the user when ordering the product, allowing the user to custom create an order during the point of purchase.

Referring now to FIGS. 14-20, there is shown a lighting display 100 that includes a sheet of material 170 that is a diffraction sheet used to reflect and diffract the light. This helps give the light a sparkle lighting effect. Positioned between the diffraction sheet and the shell 150 is an indicia sheet 172 that includes any type of pattern, configured or determined by the user. The diffraction sheet as noted above is rolled or curved and inserted within the shell 150. The material 170 is designed to have a flat configuration but is capable of being rolled or curved but has a tendency to lay flat, thus when rolled and inserted against the inside surface 158 of the shell 150, the material 170 has a tendency to return to its normal flat configuration. As such, the material 170 will hold it rolled shape against the inside surface 150 of the shell 150 and thus press against and hold the indica sheet 172 against the shell. As illustrated, the indicia sheet 172 may be removed and replaced with a second indicia sheet 174 tailored by the user to their preferences.

It may be further noted that the indicia sheets may be slightly smaller than the sheet of material or diffraction sheet 170 which leaves slight gaps along its rolled edges or along the top portion when rolled and inserted into the shell.

When illuminated, the diffuser sheet 170 lights and sparkles to indicia sheet to provide an aesthetic to the lighting display.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the claims by the embodiments illustrated.

What is claimed is:

1. A lighting display comprising:

a base housing a power source compartment, and the base includes an upper portion;

a cylindrical shell extending upwardly from an edge of the upper portion of the base, the cylindrical shell having an inside surface and an external surface;

a plurality of light diodes electrically connected to the power source and extending from the upper portion; and a first sheet of material curved and inserted against the inside surface of the cylindrical shell, and wherein the first sheet of material includes a diffraction pattern embedded therein, and wherein the first sheet of material is made from a material configurable from a flat configuration to a curved configuration and wherein when curved and inserted against the inside surface of the shell, the first sheet of material has a tendency to press against the inside surface, attempting to return to the flat configuration;

a second sheet of material, having a defined property such that the second sheet of material is configurable from a flat configuration to a curved configuration, and the second sheet of material being curved and inserted between the first sheet of material and the inside surface of the shell, wherein the second sheet of material includes an indicia pattern printed thereon; and wherein the plurality of light diodes being positioned interior to the first sheet of material illuminate through the first and second sheets of material when activated, and wherein the first sheet of material includes a diffraction pattern such that when the plurality of light diodes is activated the display sparkles with the illumination of the light diodes.

2. The lighting display of claim 1, wherein the first and/or second sheet of material is an acetate sheet, a transparency sheet, a milky paper or any type of semitransparent or translucent medium material.

3. The lighting display of claim 1, wherein the plurality of light diodes changes colors.

4. The lighting display of claim 1, wherein the first and second sheet of materials are removable, and the second sheet of material is replaced by a third sheet of material, and wherein the third sheet of material has a different indicia pattern then the second sheet of material to provide a different lighting or display effect.

5. The lighting display of claim 4, wherein the second and third sheets of material are printable with custom created indicia.

6. The lighting display of claim 1, wherein the shell includes an inside surface spaced from an outside surface configured to receive the sheets of material between the two surfaces.

7. The lighting display of claim 1, wherein the shell includes a lip or rounded terminal edge.

8. The lighting display of claim 1, wherein the plurality of light diodes are electrically connected to the power source and extend from an opening in the upper portion defined on the base.

9. A method of customizing a lighting display comprising:

providing a lighting display having a base housing a power source compartment, and the base includes an upper portion, a cylindrical shell having an inside surface and extending upwardly from an edge of the upper portion of the base; and a plurality of light diodes electrically connected to the power source and extending from the upper portion; and providing a first sheet of material with a diffraction pattern embedded therein, the first sheet of material being made from a material configurable from a flat configuration to a curved configuration;

providing a second sheet of material being made from a material configurable from a flat configuration and a curved configuration, the second sheet of material being initially blank or devoid of any indicia;

custom printing indicia on the second sheet of material;

curving and inserting the first and second sheets of material against an inside surface of the shell, such that the second sheet of material is positioned between the first sheet and the inside surface of the shell, whereby the sheets of material being configured to have a flat configuration have a tendency to press against the inside surface, attempting to return to the flat configuration, and further placing the plurality of light diodes interiorly to the sheet of material such that when the plurality of light diodes is activated the display sparkles with the illumination of the light diodes.

10. The method of customizing a lighting display of claim 9, wherein the first and/or second sheets of material are an acetate sheet, a transparency sheet, a milky paper or any type of semitransparent or translucent medium material.

11. The method of customizing a lighting display of claim 9, wherein the plurality of light diodes changes colors.

12. The method of customizing a lighting display of claim 9, further includes the step of removing the second sheet of material and replacing it with a third sheet of material with a different indicia pattern to provide a different lighting or display effect.

13. The method of customizing a lighting display of claim 9, wherein the shell includes a lip or rounded terminal edge.

* * * * *